United States Patent [19]

Jones

[11] 4,237,759

[45] Dec. 9, 1980

[54] ROTARY SLICER

[75] Inventor: Frank W. Jones, Wilmington, Del.

[73] Assignee: Redco, Inc., Wilmington, Del.

[21] Appl. No.: 46,465

[22] Filed: Jun. 7, 1979

[51] Int. Cl.[3] ..... B26D 4/38

[52] U.S. Cl. ..... 83/419; 83/356.3; 83/467 R; 83/591; 83/592

[58] Field of Search ..... 83/419, 591–596, 83/356.3, 355, 467, 468

[56] References Cited

U.S. PATENT DOCUMENTS

| | | | |
|---|---|---|---|
| 2,035,339 | 3/1936 | Powers | 83/356.3 |
| 2,807,302 | 9/1957 | Qualheim | 83/467 |
| 4,177,703 | 12/1979 | Cavier | 83/356.3 |

*Primary Examiner*—J. M. Meister

*Attorney, Agent, or Firm*—Connolly and Hutz

[57] ABSTRACT

The cutting action in a rotary slicer is provided by a pair of circular disc blades, which are mounted in apertures in a circular plate, which is rotated within an outer casing. The plate rotates adjacent a feeding chute at one side of the casing and the depth of the slice is adjusted by varying the distance of the blade in front of the circular plate. The cut slices pass between the blades and apertures into the rear of the casing, which discharges them downwardly. The blades are mounted on a lobular bracket supported on a central shaft in a fixed longitudinal position. The depth of cut is varied by moving the apertured plate back and forth along the shaft to a position governed by a C-shaped stop ring with a calibrated shaft extending outwardly from the rear shaft bearing. The plate is detachably secured to the shaft by a thumb screw accessible through an ample cut-out in the top of the rear casing. A hinged pusher urges objects in the chute into the path of the cutting blades and acts as a safety stop to prevent the handle from being turned when it is rotated out of the chute over the back of the slicer. The full circumference of the cutting discs are utilized by moving them to different angular positions relative to the bracket to which they are secured.

14 Claims, 12 Drawing Figures

21
26
24
40
28
24
40
23
38
17
32
20
30
40
36
22
18
16
28
46
12
10
44
42
80
52

Fig. 5.
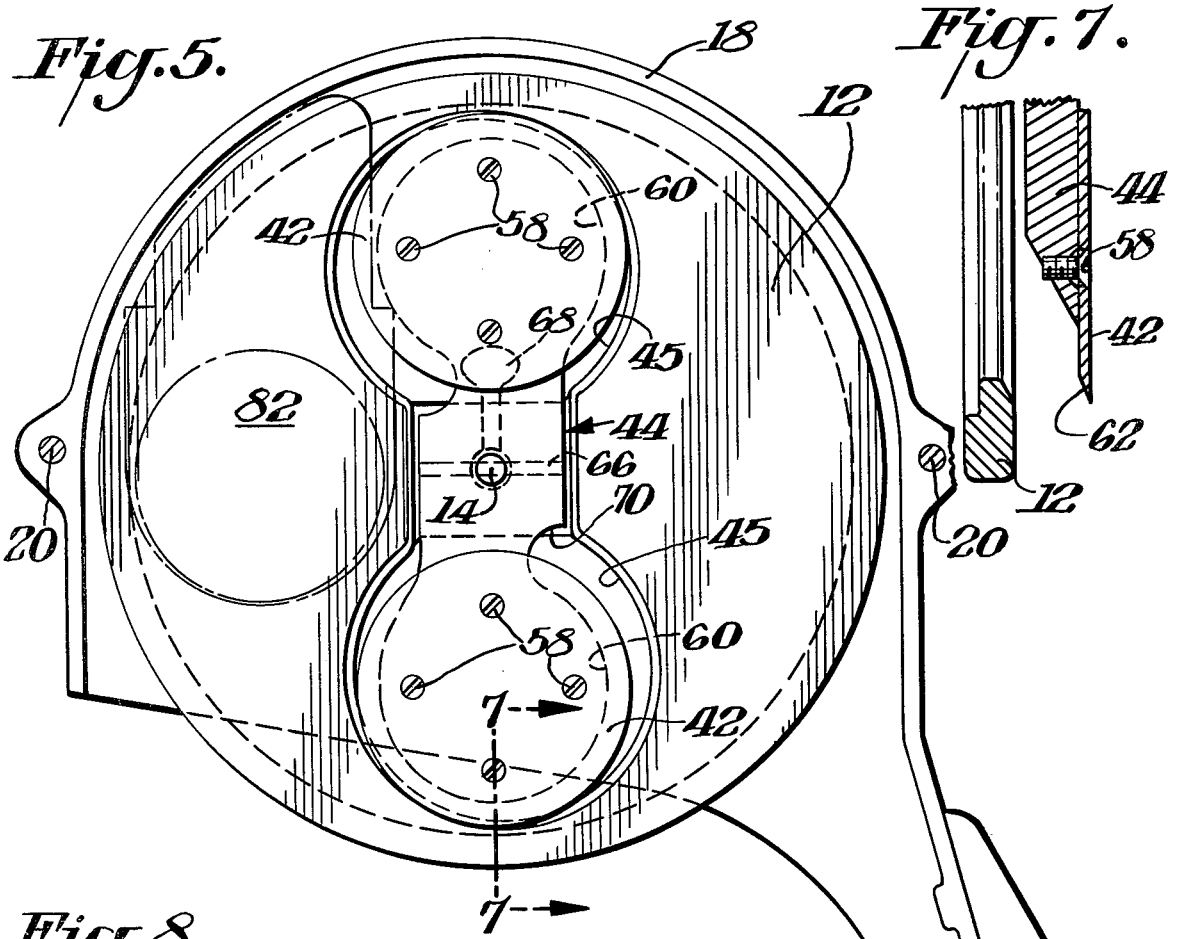
Fig. 7.
Fig. 8.
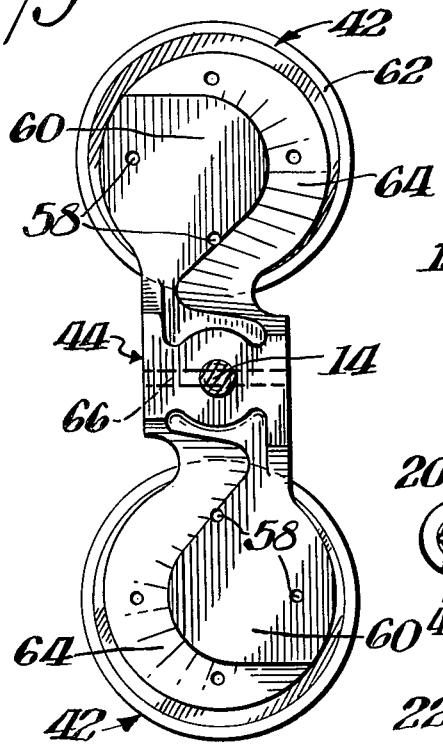
Fig. 2B.
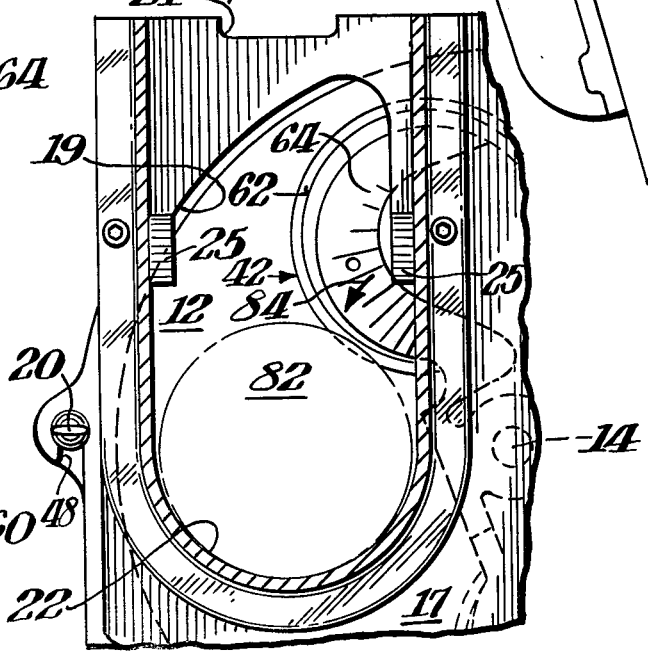

6
28
30
72
74
9
32
36
9
38
78
56
18
14
76
10
10
68
82
66
70
45
12
19
21
44
2B
2B
42
17
16
20
23
23
25
26
10
22
24
40
6

76
78
14
74
18

ROTARY SLICER

BACKGROUND OF THE INVENTION

There are in existence a wide variety of rotary slicers employing circular cutting assemblies into which food objects are supplied to slice and chop them. Such existing slicers have certain individual favorable characteristics and operate satisfactory for a given period of time, but are not as generally efficient as might be desired and their cutting edges rapidly lose their sharpness, which necessitates frequent replacement. An object of this invention is to provide a rotary slicer which has a high overall efficiency, does not require frequent blade replacement and which is efficient and safe to operate.

SUMMARY

In accordance with this invention, the cutting action of a rotary slicer is accomplished by sharp circular cutting discs mounted in apertures in a circular cutting plate, which rotates within a casing. The objects to be sliced are fed into the cutting blades through a chute in one side of the casing. A rotatable pusher is, for example, mounted in the chute to cause its weight to urge its objects into the cutting blades. The thickness of the slices is governed by the projection of the cutting disc ahead of the aperture. This projection is adjusted by changing the position of the circular plate along the fixed shaft of the cutting assembly. The adjustment is, for example, guided by an adjustable stop with a calibrated stem extending outside of the casing. The circular plate is secured to the shaft, for example, by thumb screw, which is accessible through an ample opening in the top of the rear casing. The cutting discs are mounted on a lobular bracket secured to the rotating shaft of the slicer. The leading edges of the bracket are beveled to reduce resistance and smoothly divert the slices through the apertures in the circular chute. The angular position of the cutting discs on their supporting bracket is variable, such as to four different positions to utilize all portions of the blade periphery. Four different sections of the cutting blades can, therefore, be individually deployed in the cutting position.

BRIEF DESCRIPTION OF THE DRAWINGS

Novel features and advantages of the present invention will become apparent to one skilled in the art from a reading of the following description in conjunction with the accompanying drawings wherein similar reference characters refer to similar parts and in which:

FIG. 2B is a fragmentary cross sectional view taken through FIG. 4 along the line 2B—2B with cutters slightly rotated;

FIG. 5 is a front elevational view of the slicer shown in FIGS. 1–4 with the front casing removed;

FIG. 7 is a cross-sectional view taken through FIG. 5 along the line 7—7;

FIG. 8 is a rear view in elevation of the twin cutting blade and bracket assembly shown in FIGS. 3–7;

DESCRIPTION OF THE PREFERRED EMBODIMENT

Figure 1:
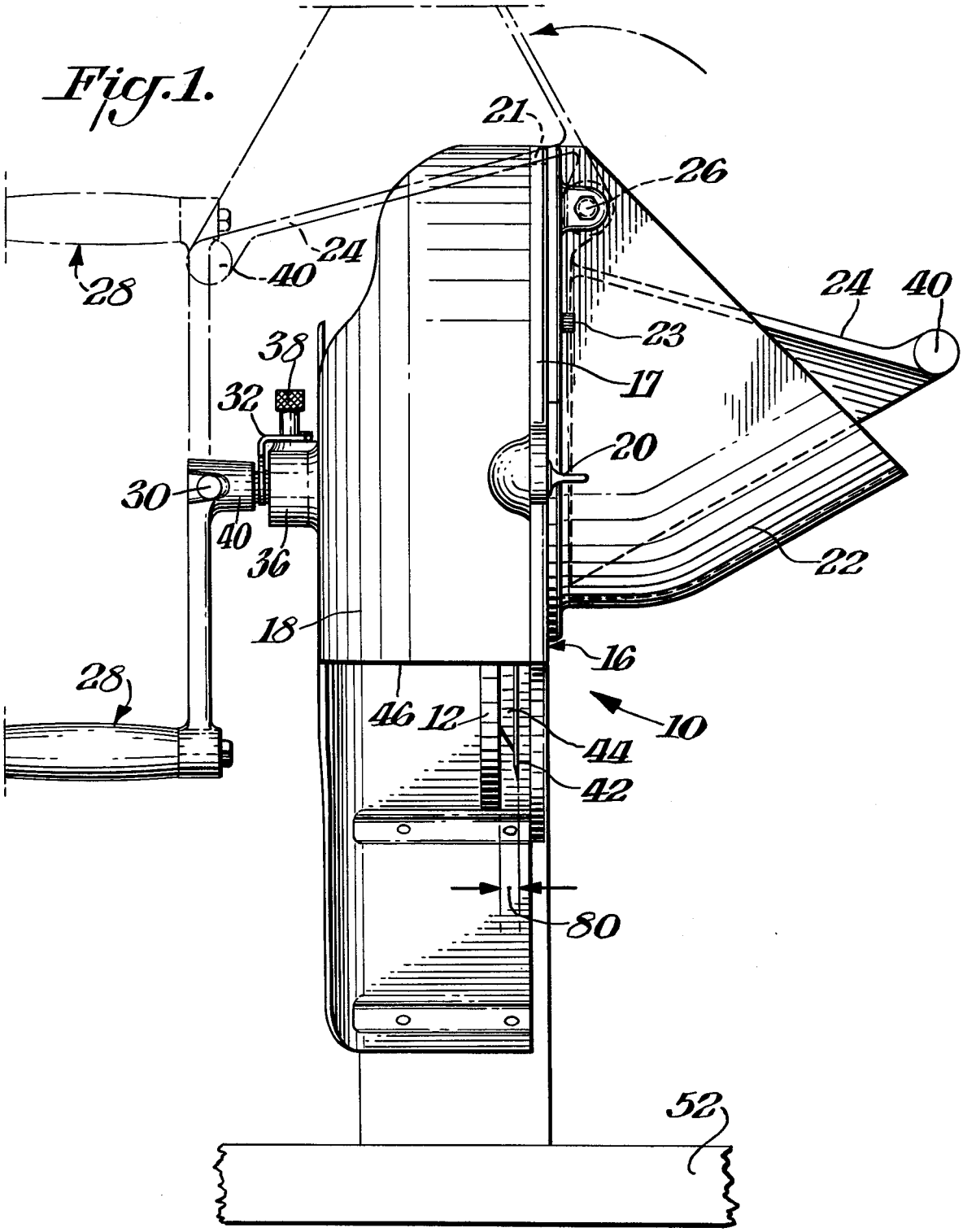
FIG. 1 is a side elevational view of one embodiment of this invention.

In FIGS. 1–6 is shown a rotary slicer 10 having a rotary apertured circular plate 12 rotatably mounted on shaft 14 and disposed within casing 16. Casing 16 has a front cover 17 detachably secured to a rear housing 18 by thumb screws 20. Chute 22 is detachably secured to the front of cover by socket headed screws 23. All portions of the slicer 10 unless specifically mentioned, are made of a relatively inexpensive aluminum.

FIG. 1 also shows pivoted pusher 24 mounted on horizontal shaft 26 to pivot in and out of chute 22. When rotated to the rear position (shown in phantom outline) in FIG. 1, it is disposed in the path of movement of handle 28, also shown in phantom outline to prevent handle 28 from being rotated when chute 22 is fully opened. This provides the safety feature of preventing operation when chute 22 is open. Notch 21 (shown in FIGS. 1–4) receives and supports handle 24 in the withdrawn position. Objects loaded within chute 22 pass through opening 19 in cover 17 and are sliced in the manner later described. Lugs 25 at the side of chute 22 provide a limit of travel for pusher 24.

Figure 9:
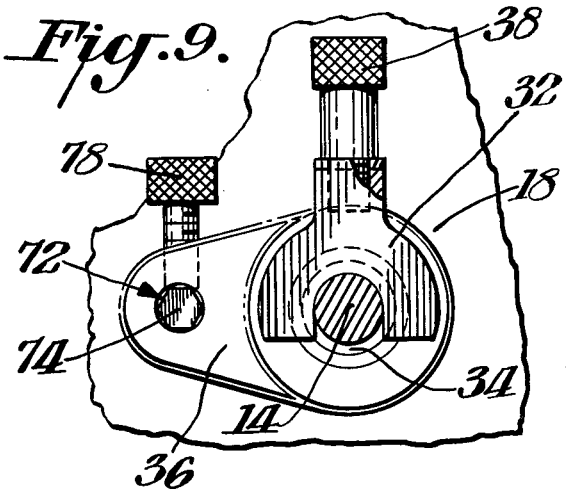
FIG. 9 is a cross-sectional view taken through FIG. 4 along the line 9—9.

FIG. 1 also shows set screw 30 securing handle 28 to shaft 14. Retaining clip 32 shown in FIGS. 1, 6 and 9 engages into groove 34 in shaft 14 to lock its axial position. Clip 32 is secured to rear bearing hub 36 on rear casing or housing 18 by knurled screw 38.

Figures 2, 2A:
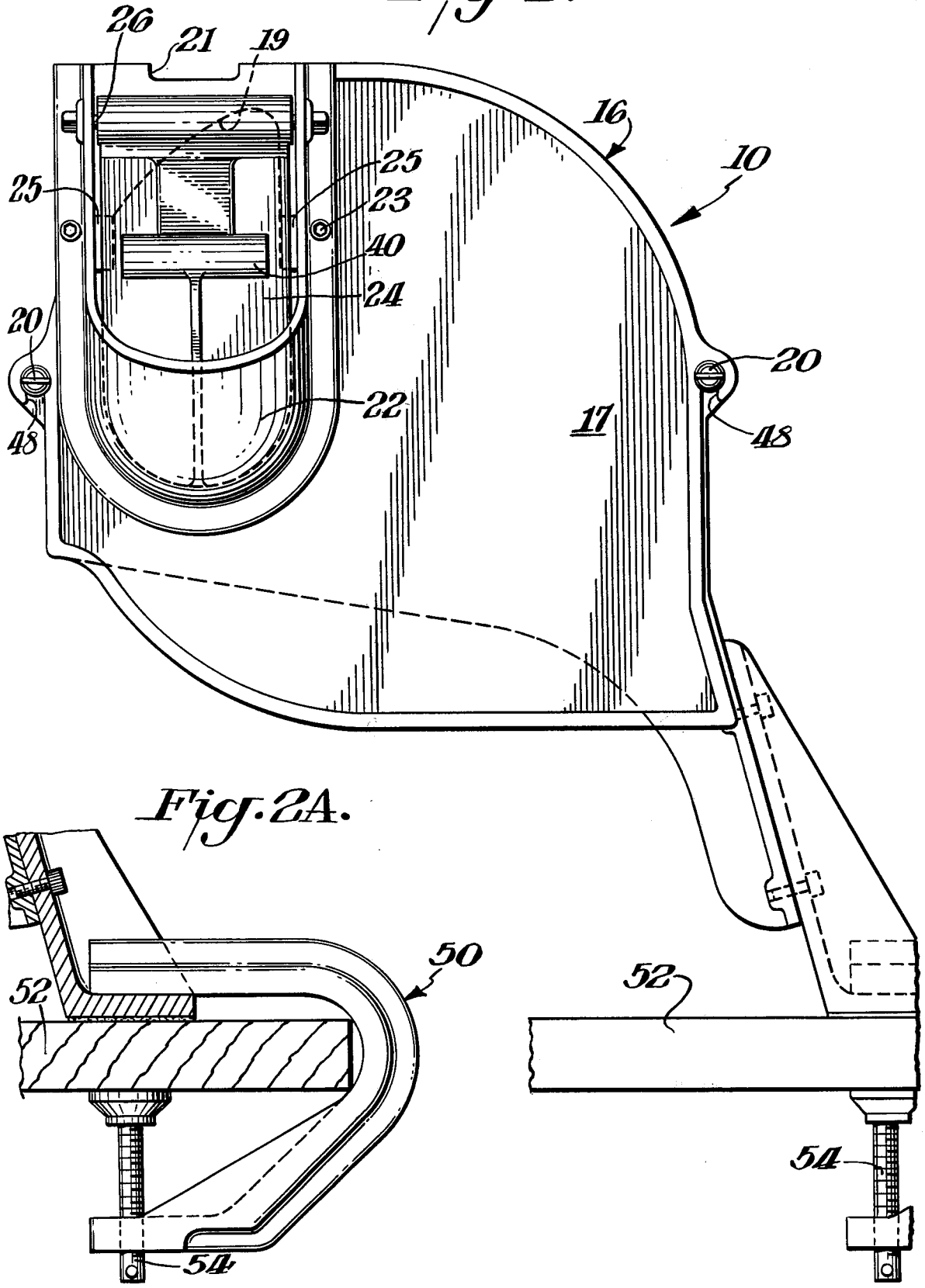
FIG. 2 is a front elevational view of the slicer shown in FIG. 1.
FIG. 2A is a fragmentary cross-sectional view of the foot and clamp partially shown in FIG. 2.

FIG. 2 shows the open end of chute 22 with plunger 24 disposed within it. Handle 40 on plunger 24 affords a means of manipulating plunger 24 and as shown in FIG. 1 in phantom outline is disposed in the path of operating handle 28 when chute 22 is unobstructed.

FIG. 1 also shows a portion of one of two circular cutter blade discs 42 and lobular bracket 44 extending in front of apertured circular plate 12 below discharge opening 46 in the bottom of rear housing 18. Sliced objects are discharged downwardly through opening 46.

FIG. 2 also shows how front cover 17 is secured to rear housing 18 by thumb screws 20 inserted in open slots 48 in the side edges of front cover 17. Front cover 17 and chute 22 may accordingly be removed by merely loosening thumb screws 20. In FIGS. 2 and 2A is also shown C-shaped mounting clamp 50 for securing slicer 10 to table 52 by tightening screw 54. Clamp 50 thus supports slicer 10 a distance above the table to provide free discharge of sliced objects into a pan (not shown) resting on table 52.

Figure 3:
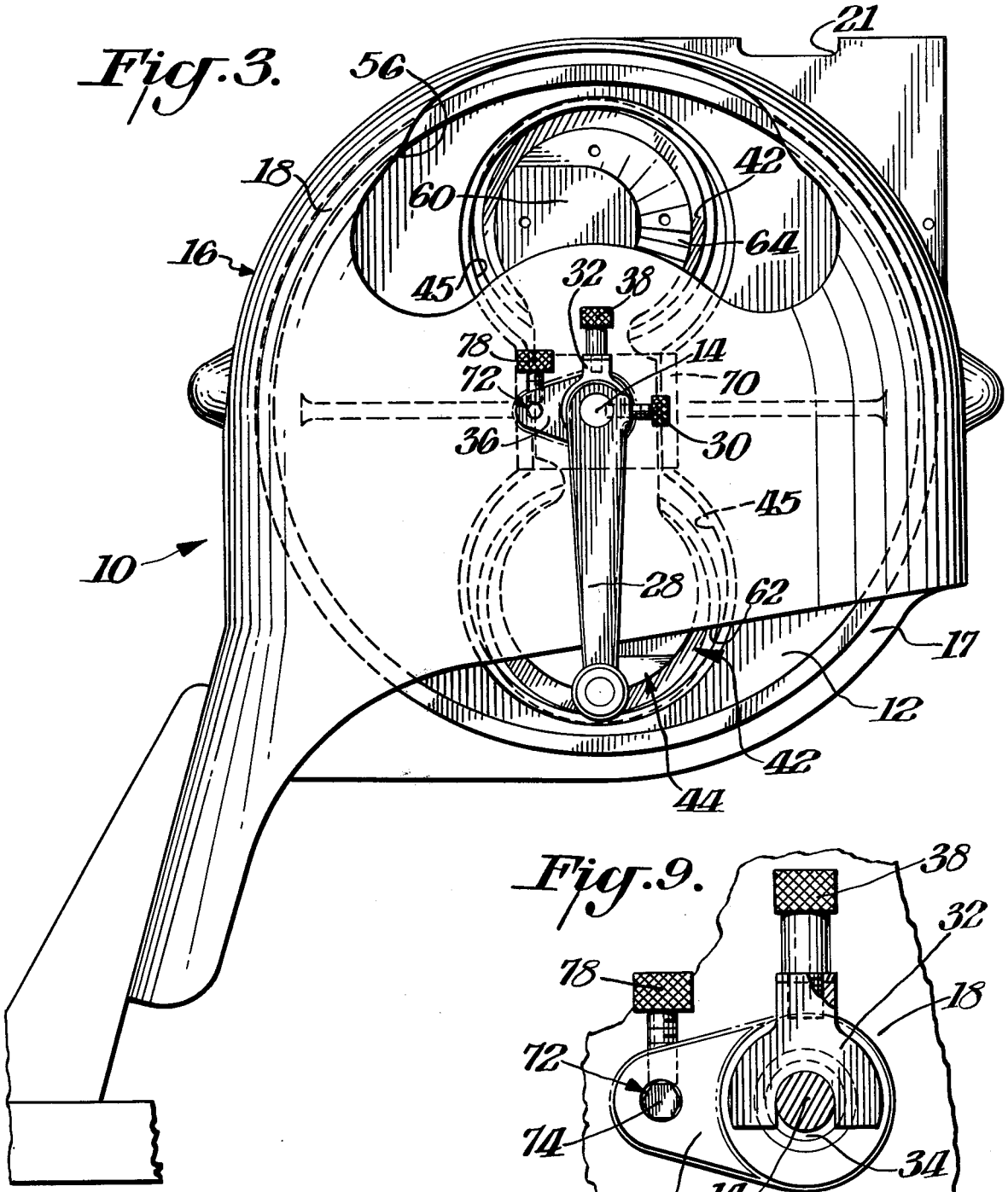
FIG. 3 is a rear elevational view of the slicer shown in FIGS. 1 and 2.
Figures 4, 10:
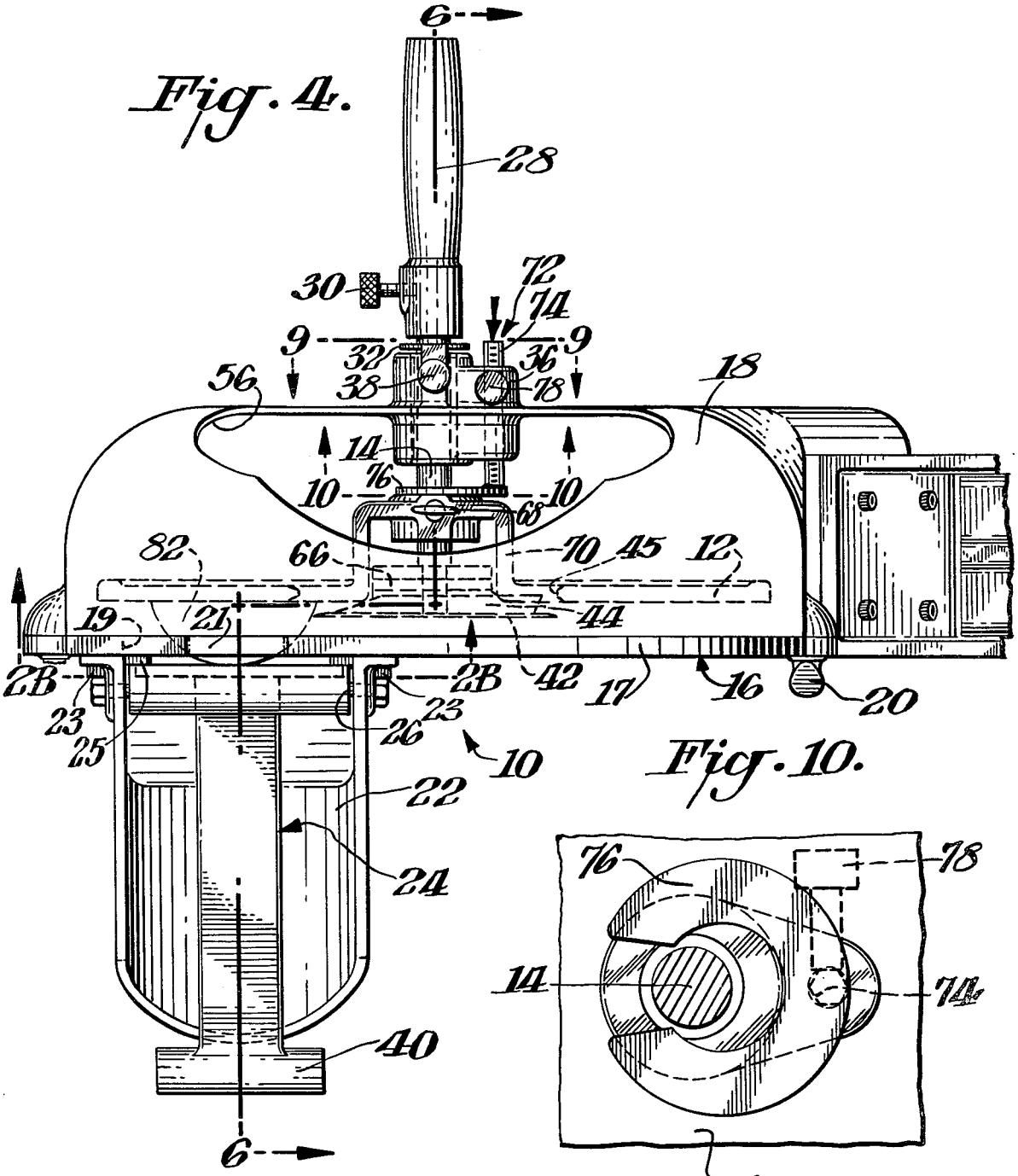
FIG. 4 is a top plan view of the slicer shown in FIGS. 1–3.
FIG. 10 is a cross sectional view taken through FIG. 4 along the line 10—10.
Figure 6:
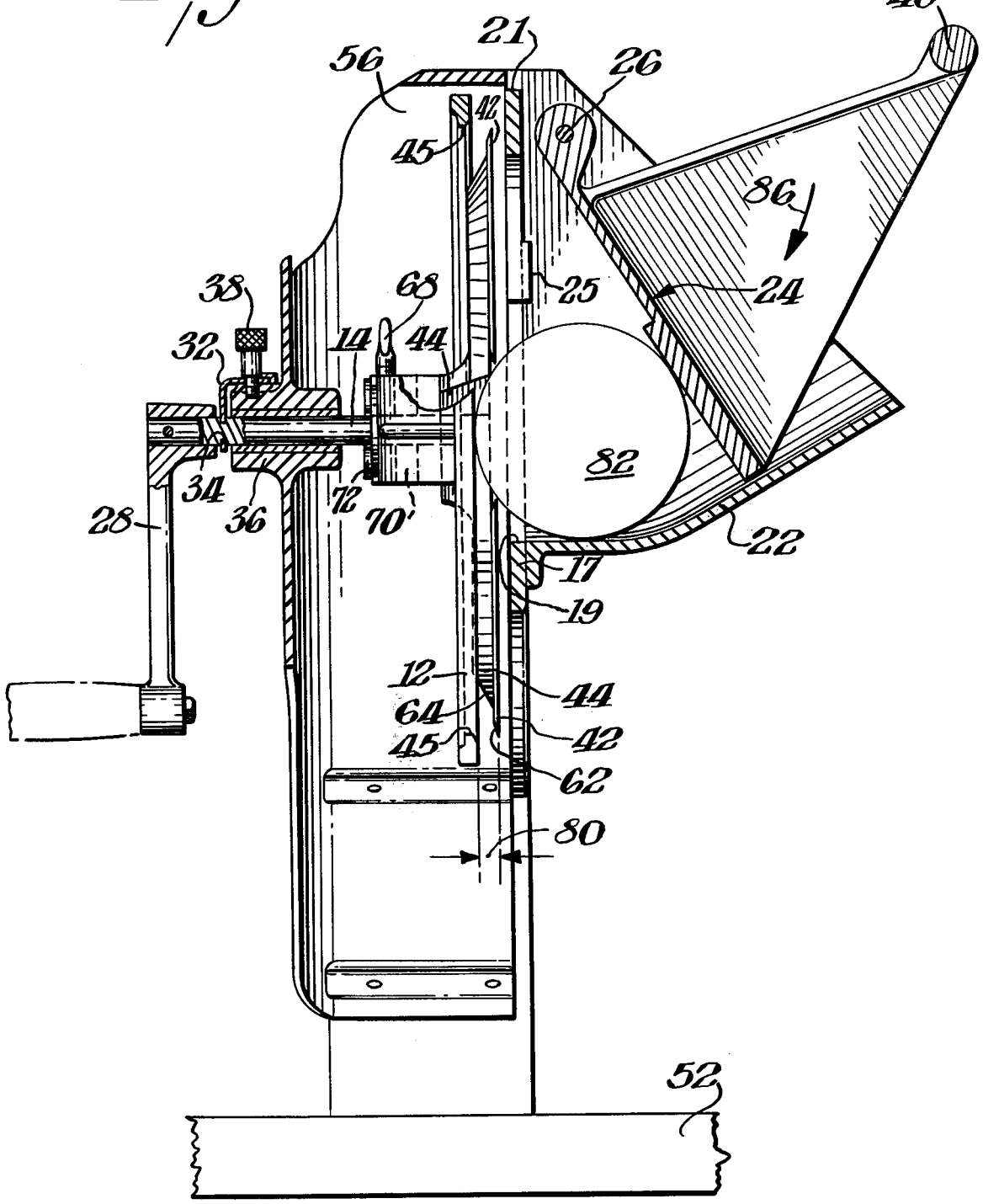
FIG. 6 is a cross-sectional view substantially taken though FIG. 4 along the line 6—6.

FIG. 3 shows access opening 56 in the top of rear housing 18 through which operation of the slicing action may be observed and the cutting thickness adjusted as later described. In FIG. 3 in conjunction with FIGS. 5, 6 and 8 is shown twin cutter discs 42 secured to lobular bracket 44 by counter sunk flat head screws 58 threaded into paddle-shaped lobes 60 of bracket 44. Screws 58 are disposed at 90° intervals in a circular array on lobes 60 to permit the position of cutter discs 42 to be varied at 90° intervals. In other words, four different cutting surfaces may be utilized about the peripheries of cutter discs 42. Discs 42 are highly sharpened to provide a bevel 62 on their rear edges. FIGS. 1, 2B, 4, 6, 7 and 8 show how the leading rear edges 64 of bracket 44 are beveled to provide a smooth continuation of the beveled edge 62 of the cutter disc 42. This helps smoothly divert slices into the interior of rear housing 18 and minimizes the force necessary to operate slicer 10. FIGS. 4 and 5 also show how bracket 44 is secured on the end of shaft 14 by pin or set screw 66.

FIGS. 4 and 6 shows how circular plate 12 is variably secured to shaft 14 by thumbscrew 68 threaded into open hub 70 extending from the rear of circular plate 12. The axial position of plate 12 is adjusted by varying the axial position of stop 72, which includes a distance-calibrated hexagonal stem 74 to which C-shaped stop washer 76 is attached. Stop stem 74 is secured within rear hub 36 by a knurled set screw 78. C-shaped stop washer 76 is set to provide the desired thickness of slice by reading calibrated stem 72, and plate 12 is set to provide this slice in conjunction with the edge of cutter blade disc 42, which in conjunction with lobular bracket 44 is disposed in front of lobular aperture 45 in plate 12. Plate 12 is adjusted by moving hub 70 into contact with C-shaped ring 76. Thumb screw 68 is tightened to secure the axial position of plate 12 on shaft 14. This disposes cutter disc 42 the desired thickness of slice 80 (shown in FIG. 1) in front of circular plate 44. The direct manipulation of plate 12 on shaft 14 simplifies its adjustment and avoids any complicated linkage, which might bind in service.

FIGS. 2B, 5 & 6 show an object such as an onion 82 in chute 22 just prior to and as slicing is initiated by one of cutter discs 42. In FIG. 2B arrow 84 shows the direction of movement of cutter disc 42 into onion 82. A highly efficient cutting action is provided by the circular shape of cutter disc 42 and the ability to rotate it to different angular positions as its leading cutting surface loses its sharpness. Cutter blade 42 provides more than four time the sharp cutting service of a blade having one fixed position relative to the objects being sliced.

FIG. 6 shows plunger 24 urged by gravity in the direction of arrow 86 to push an object such as onion 82 into contact with circular plate 12. Cutter blade 42 at distance 80 in front of circular plate 12 cuts a slice from objects 82 equal in thickness to distance 80, which may be adjusted as previously described to provide slices, which range, for example, from 1/16 inch to 1¼ inch.

Slicer 10 has the advantage of heavy duty performance at a high production rate without requiring any motors or electric cords. It is much less expensive than an electric slicer and can be positioned without necessity of a nearby electric outlet. It is extremely effective for all purposes without changing cutting blades. It slices, dices, chops, and is great for producing cole slaw. It has an easy to read slice thickness indicator. It is extremely reliable in performance, including shredding cabbage for cole slaw, shaving jumbo Spanish onions to super-thin ⅛ inch ringlets, chopping cucumbers as fast as the handle can be turned, shredding lettuce for subs and tacos and will also rapidly chop celery and carrots. It is also effective for slicing potatoes and citrus fruits.

Another important advantage is its variable angle circular cutting disc, which can be moved into four different angular positions. When the leading surface being used becomes dull, the next super-sharp surface is rotated into position by removing and replacing the four securing screws. The ample feeding and discharging passageways also provide highly smooth and efficient cutting action in conjunction with the beveled leading edge of the bracket supporting the cutter discs. The generous size housing safely shields cutting mechanism, and the handle plunger prevents rotation of the operating handle when it is rotated out of the chute. This is an important safety feature.

The apertured circular plate 12, lobular bracket 44 with blade discs 42 and shaft 14 can be quickly removed for cleaning or securing by the following steps:

(1) Loosen thumb screw 20 and slide off front cover 17;
(2) Loosen set screw 30 and remove handle 28;
(3) Remove screw 38 and retaining clip 32; and
(4) The entire cutter assembly and shaft can be removed.

I claim:

1. A rotary slicer comprising a hollow casing, bearing means on the casing, a shaft rotatably mounted in the bearing means, drive means connected to the shaft for rotating it, an inlet in the casing for supplying objects to be sliced, a rotary plate disposed within the casing on the shaft adjacent the inlet, a slicing assembly mounted on the shaft for rotation therewith, rotational bearing means connected to the shaft, apertures in the place substantially corresponding to the slicing assembly, adjustable means securing the plate to the shaft whereby the distance between the cutting discs and the plate may be varied for adjusting slice thickness, the slicer assembly including circular cutter discs mounted on the bracket, and cutter discs being connected to the bracket by an angularly variable means whereby different portions of the cutter discs may be successively utilized.

2. A rotary slicer as set forth in claim 1, wherein the angularly variable securing means comprises a circular array of screws.

3. A rotary slicer as set forth in any one of claims 1 and 2, wherein the bracket has leading edges, and the leading edges are beveled to minimize driving force.

4. A rotary slicer as set forth in any one of claims 1 or 2, wherein a loading chute is disposed in line with the inlet to the casing and a gravity biased pusher is mounted on the chute.

5. A rotary slicer as set forth in claim 1, wherein the circular discs are mounted on a lobular bracket, the lobular bracket is secured to the staff, and the portion of the plate aligned with the bracket is correspondingly apertured.

6. A rotary slicer as set forth in claim 1, wherein the driving means comprises a manual-operated handle.

7. A rotary slicer as set forth in claim 6, wherein pusher means is rotatably mounted adjacent the inlet for urging objects into the inlet, and the pusher means being constructed and arranged to obstruct the operating handle when it is withdrawn from the chute.

8. A rotary slicer as set forth in claim 1, wherein the axial position of the plate is obtained by screw means reacting between the plate and the shaft.

9. A rotary slicer as set forth in claim 1, wherein the plate is secured to the shaft by a manually operable screw, and an aperture is provided in the casing to provide access to the screw.

10. A rotary slicer as set forth in claim 9, wherein a stop indicator having a portion disposed outside of the casing is axially adjustable to guide the setting of the plate axially along the shaft and the thickness of slice obtained from the slicer.

11. A rotary slicer as set forth in claim 10, wherein the stop indicator has a C-shaped ring and stem.

12. A rotary slicer as set forth in claim 1, wherein the shaft includes a peripheral groove, the bearing means is incorporated in a hub on the casing, a slot is disposed in the hub in line with the groove, and a retaining clip is detachably mounted on the hub and extending into engagement with the groove through the slot whereby the shaft is axially locked in the casing in a detachable manner.

13. A rotary slicer as set forth in claim 12, wherein the hollow casing has a front cover and quick uncoupling means connects the front cover to the remainder of the casing to facilitate rapid disassembly and reassembly of the slicer.

14. A rotary slicer as set forth in claim 13, wherein the shaft, bracket and cutting discs comprise a unit assembly which may be removed and reassembled as a unit, rotary plate being attached to the shaft by the adjustable means, and the adjustable means comprising a thumb screw.

* * * * *